United States Patent [19]

Giger

[11] Patent Number: 4,655,606

[45] Date of Patent: Apr. 7, 1987

[54] TIMEPIECE COMPRISING AT LEAST ONE CHRONOGRAPH FUNCTION

[75] Inventor: Urs Giger, Solothurn, Switzerland

[73] Assignee: ETA SA Fabriques d'Ebauches, Switzerland

[21] Appl. No.: 710,803

[22] Filed: Mar. 12, 1985

[30] Foreign Application Priority Data

Mar. 28, 1984 [CH] Switzerland ..... 1559/84

[51] Int. Cl.[4] ..... G04F 5/00

[52] U.S. Cl. ..... 368/160; 368/113

[58] Field of Search ..... 368/110-113, 368/151, 160

[56] References Cited

U.S. PATENT DOCUMENTS

| | | | |
|---|---|---|---|
| 3,726,081 | 4/1973 | Schneiter | 368/110 |
| 3,884,035 | 5/1975 | Jeannet et al. | 368/110 |
| 4,211,066 | 7/1980 | Kusumoto et al. | 368/113 |
| 4,270,197 | 5/1981 | Minowa | 368/113 |
| 4,364,669 | 12/1982 | Thoenig et al. | 368/111 |
| 4,537,514 | 8/1985 | Moriya | 368/113 |

FOREIGN PATENT DOCUMENTS

| | | |
|---|---|---|
| 225004 | 12/1942 | Switzerland . |
| 527462 | 10/1972 | Switzerland . |
| 2028545 | 3/1980 | United Kingdom . |

*Primary Examiner*—Bernard Roskoski

*Attorney, Agent, or Firm*—Griffin, Branigan & Butler

[57] ABSTRACT

The timepiece of the invention includes at least a seconds hand arranged to respond to a chronograph mechanism. It comprises a single motor which receives at least two pulses per second so as to cause the seconds hand to advance by at least two steps per second. The system as disclosed enables an improvement in readability of the precision of time intervals on the one hand and on the other hand assures certain operation of the chronograph while using a stepping motor dimensioned to drive a simple timekeeper.

6 Claims, 2 Drawing Figures

TIMEPIECE COMPRISING AT LEAST ONE CHRONOGRAPH FUNCTION

The present invention concerns a timepiece including an electronic oscillator serving as time-base, a frequency divider and a stepping motor driving at least a seconds hand arranged to respond to a chronograph mechanism through operation of which said seconds hand may be started, stopped and returned to its initial position.

BACKGROUND OF THE INVENTION

Mechanically driven chronograph watches comprise generally a central seconds hand which upon actuation of the start mechanism is coupled to the gear train and advances step by step at the frequency which is determined by the balance wheel and hairspring. If this frequency is 18,000 alternations per hour, the seconds hand will progress step by step 18,000:3,600=5 steps per second, i.e. through an angle of 1.2° per step. If the hand moves over a dial on the order of 30 mm of diameter, this stepwise displacement of its extremity over the hours division is easily visible (arc of about 0.3 mm). In this case the smallest period which can be read is on the order of a fifth of a second.

Attempts have already been made to obtain chronograph watches of the electronic type where the balance wheel and hairspring mechanism is replaced by a quartz time-base which controls by means of a frequency divider a stepping motor which is caused to step once per second.

This is the case for example in the construction described in the U.S. Pat. No. 3,884,035 which provides however at least two driving motors, one for the timekeeping display and the other for the chronograph function display. In a variant of this arrangement the frequency divider circuit includes two outputs at different frequencies, one being at 1 Hz in order to control the motor of the timekeeper and the other of at least 8 Hz so as to control via a starting switch and an auxiliary frequency divider, the motor or motors of the chronograph. When the switch is operated the auxiliary divider begins to count the 8 Hz pulses received from the principal frequency divider in order to deliver at its output one control pulse for every 8 impulses received at its input. In this manner it will be understood that the display error may attain the value of −1 second if the chronograph function is started just before the arrival of the eighth pulse. It will be noted in passing that this error could be ±1 second at most if there were no auxiliary frequency divider and the chronograph motor were controlled directly by the 1 Hz pulses from the principal frequency divider.

It remains nonetheless the case that for a chronograph function even an error of −1 second remains important relative to the reading of a fifth of a second which one may obtain with a classical mechanical chrongraph. To overcome this difficulty the U.S. Pat. No. 3,884,035 cited above foresaw as a variant the utilization of a further motor driven at a frequency higher than 1 Hz which then displayed fractions of a second. Initially, it will be noted that the complication of such a system is a serious obstacle to its commercial realization. Furthermore, from the admission of the inventor, the utilization of several motors can considerably increase the current consumption to a point such that a supplementary energy source may be necessary.

The watch chronograph described in the British patent document No. A-2,028,545 likewise employs two stepping motors one of which drives the wheel train for indicating the time of day and the other, the chronograph wheel train. The chronograph motor is controlled by pulses provided from the divider circuit at a frequency of 10 Hz. The central seconds hand which forms part of the chronograph display mechanism is driven at a speed of rotation ten times the normal speed so that it effects one sweep of the dial in 6 seconds. In this manner it is possible to read a tenth of a second. However, the reduction ratios which are necessary in the chronograph wheel train to drive a minutes counter and an hours counter are then such that encumbrance of the movement becomes important. It is likewise to be noted that the reading of periods of a duration less than 1 minute but greater than 6 seconds is not facilitated.

In mechanical chronograph watches it is current practice that the chronograph mechanism in its quasi totality is borne on an independent support which is removably fastened to the support of the movement as taught for example by Swiss Pat. Nos. 225 004 and 527 462. This manner of construction can be advantageous without requiring an increase in the mechanical power of the motor equipping the base movement, said motor possessing sufficient reserve to drive the overload presented by the chronograph mechanism.

This same principle has been applied more recently to a basic movement employing a quartz and a stepping motor. However, when it has come to the mounting of the chronograph mechanism on the basic movement employing a single stepping motor normally driving only a simple timekeeper, it has been noted that the energy furnished by the motor is at the limit of acceptability which is understandable since the motor must drive an additional load for which it has not been calculated. From this situation there results insecurity of operation appearing above all with the application of special external constraints. To overcome these difficulties consideration has been given to increase the power to be furnished by the stepping motor, this leading in turn to an increase in its dimensions and from there modifying in a substantial manner the thickness and the arrangement of the entire basic movement. One thus departs from the prime purpose taught by the Swiss Pat. Nos. 225,004 and 527,462 as cited which permitted the utilization of a standard universal caliber apt to be employed in a simple timekeeper of minimum thickness or in a chronograph watch.

It will be likewise noted that the known chronograph watch as cited in the preceding paragraph, is equipped with a stepping motor which steps at one step per second. As has been explained above, the measurement error may extend to ±1 second which in many cases is not acceptable.

SUMMARY OF THE INVENTION

This invention overcomes the difficulties as cited hereinabove by arranging a frequency divider to supply the stepping motor with at least two drive pulses per second, thereby to advance the seconds hand by at least two steps per second.

DESCRIPTION OF THE PREFERRED EMBODIMENT

Figure 1:
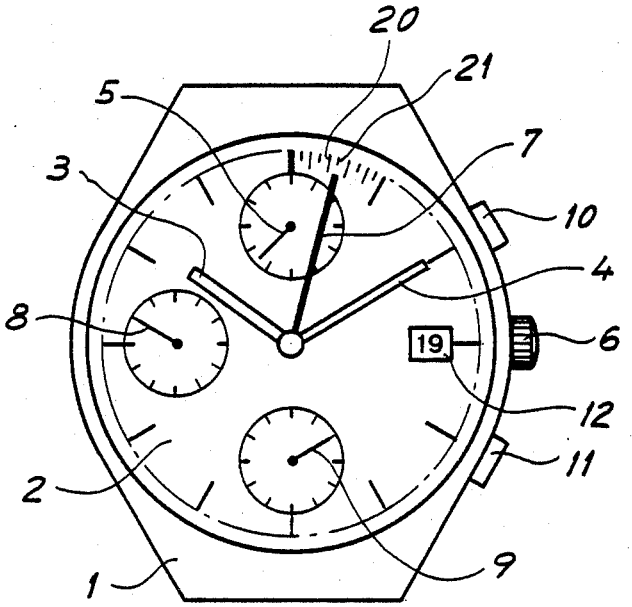
FIG. 1 is a plan view from above of one form of execution of the timepiece.

The timepiece shown in FIG. 1 comprises a case 1 which contains all of the mechanisms and necessary circuits for the display which appears on dial 2 above which several hands may move. In the chosen example the timepiece is a chronograph watch. The time of day is displayed by means of an hours hand 3, a minutes hand 4, a small seconds hand 5 and a date indicator 12. Time setting is effected by means of crown 6. The chronograph display comprises for its part a large central seconds hand 7, a minutes counter 8 and an hours counter 9. The chronograph is controlled by a starting and stopping push-piece 10 and by a zero resetting push-piece 11.

Figure 2:
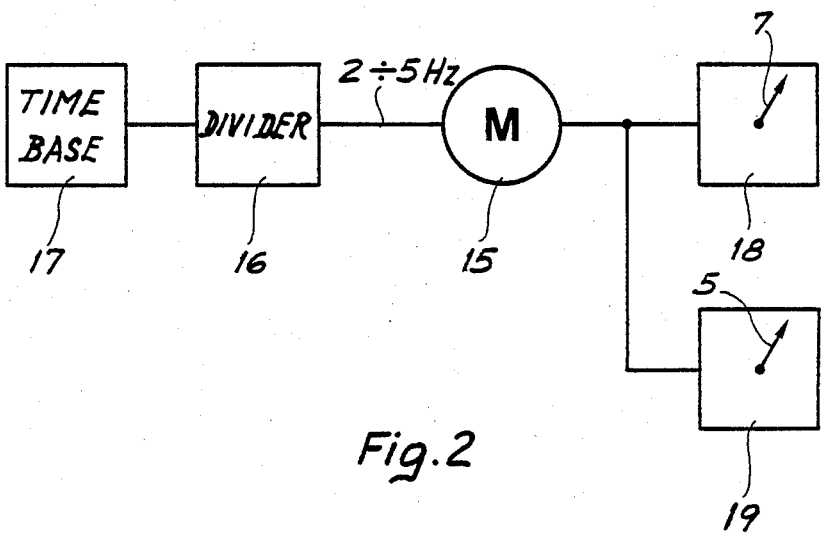
FIG. 2 is a block schematic drawing of the energization of the stepping motor equipping such timepiece.

Thus the time-piece described includes at least a seconds hand responding to a chronograph mechanism through the use of which said hand may be started, stopped, then brought back to its starting position. In the timepiece of the invention the hands are driven from a single stepping motor 15 controlled by a frequency divider 16 in its turn controlled by a time-base 17 as shown by FIG. 2. The axis of the stepping motor controls the display mechanism of chronograph 18. In the case of the chronograph watch shown in FIG. 1, the motor 15 likewise controls a time-keeping display mechanism 19 with its small seconds hand 5. It should be noted that motor 15 is preceded by a pulse forming circuit which receives signals from divider 16 such circuit not being shown on the drawing.

Relative to the prior art cited hereinabove, the invention is distinguished by the fact that the frequency divider 16 is arranged to supply motor 15 with at least two motor drive pulses per second, thereby causing the seconds hand 7 to advance correspondingly by at least two steps per second. This appears in the division over which is displaced the seconds hand 7 of FIG. 1 where between two indicia 20 indicating seconds there is disposed a supplementary index 21 indicating half-seconds. If the time-base 17 is a quartz oscillator furnishing 32,768 alternations per second, the divider 16 will include 14 divide-by-two stages in order to furnish at its output a frequency of 2 Hz. In the same manner, a divider 16 comprising 13 divider stages will furnish at its output a frequency of 4 Hz.

This hitherto unpublished manner of proceeding provides at least two advantages:

Relative to a chronograph hand beating seconds, the invention permits a two-fold improvement of the reading precision, the error for a progression of two steps per second being at maximum ±0.5 seconds. It will be understood that this error may further diminish if the number of steps per second increases.

At 5 Hz, it will certainly be no more than ±0.2 seconds. Thus appears the first advantage.

The second advantage comes about from the fact that by increasing the number of pulses per time unit, the motor may drive heavier loads if the step down ratio between the axis of the rotor and the axis of the hand increases in the same proportions. Thus a stepping motor calculated for driving a simple time-piece display mechanism may be employed for driving a chronograph mechanism demanding greater power and even a chronograph mechanism shunted onto a time-keeping mechanism, this without increasing the dimensions of the motor.

A concrete example will help to establish the idea. The chosen stepping motor is calculated for driving a timekeeper movement with a large seconds hand. The motor makes two steps per revolution and the seconds hand advances by jumps of 6° each second. Under these conditions the step down ratio is 30 and the couple measured on the axis of the seconds hand is 6 μNm. If now one energizes the same motor in a manner such that the hand advances by steps of 3° each half second the step down ratio will be increased to 60 and the couple available on the seconds hand will increase to 12 μNm. It will thus be understood that the artifice proposed enables the driving of a movement requiring a higher couple with a motor the dimensions of which do not vary. This is of importance above all for movement calibers which are required to exhibit minimum thickness.

This reasoning may be extended to a simple timekeeper movement initially provided with a seconds hand progressing one step per second. Theoretically, in accordance with what has been said above, it would be possible to diminish the dimensions of the motor if one were to drive this same mechanism at double the frequency since the couple to be furnished by the motor is two times less. It must not however be lost from view the fact that most of the time the motor is not loaded and operates almost idling. However, to assure stepping it is necessary to provide the rotor with a well defined positioning couple between steps which requires in turn that one provide the motor with a mutual couple magnet-to-winding sufficient to overcome the positioning couple. Moreover, the mutual couple must be sufficiently high to overcome internal friction of the motor itself. Finally, the construction of the motor must be such that it is resistant to parasitic exterior fields. The requirements which have just been listed are generally such that the dimensions of the motor are already reduced to a reasonable minimum so that it is scarcely thinkable to reduce them further without risks to the reliable operation of the watch movement.

It remains to be seen what happens to the current consumption when one increases the frequency of energization according to the invention. It is known that in a watch movement the average consumption in amperes is given by:

$$Cm = CCi + Cmot \cdot n/60$$

where

Cm = the average consumption (A)

CCi = the consumption of the integrated circuit (A)

Cmot = the consumption of the motor at 1 Hz n = the number of pulses per minute.

If the consumption of the integrated circuit may be generally considered as constant, the above formula shows that the average consumption increases with the number n of pulses per minute. In setting CCi = 0.3 μA, Cmot = 1 μA, one arrives at an average consumption Cm of 1.3 μA for n = 60 (seconds hand advancing per step of 1 second = 6°) and of 2.3 μA for n = 120 (seconds hand advancing per step of 0.5 second = 3°). The consumption at 1 Hz of 1 μA corresponds to that of a simple watch movement of a known type. It will be noted that the average consumption goes from 1.3 to 2.3 μA when one doubles the frequency. This increase would pass from 1.3 μA to 5.3 μA if the seconds hand were to advance 5 steps per second which is still admissible from the viewpoint of the life duration of the battery which drives the motor.

It is also to be noted that such a consumption may be greatly reduced if one energizes the motor by pulses of which the width is slaved to the load which it is called upon to drive. If one is concerned with a chronograph watch it will be understood that the wide pulses will be necessary only during the time when the chronograph is running while in normal function the watch will be satisfied with reduced energy. It is apparent therefrom that the values of 2.3 $\mu$A and of 5.3 $\mu$A given hereinabove could be reduced in considerable proportions if a slaving system were to be employed.

To have the seconds hand advance more than 5 steps per second seems to be not justified since on one hand one increases the timepiece consumption and on the other hand one causes the hand to advance by steps which are no longer visible, in any case for a dial of which the diameter is less than 30 mm.

What I claim is:

1. A timepiece including an electronic oscillator serving as a time base, a frequency divider and a stepping motor controlling both a time-keeping display and at least one chronograph-hand distinct from said time-keeping display, said chronograph-hand being arranged to respond to a mechanism through operation of which said chronograph-hand may be started, stopped and returned to its initial position, said frequency divider being arranged and adapted to supply the motor with from two to five pulses per second thereby to advance said chronograph-hand two to five steps per second, said stepping motor being the only source of electromotive power for driving said time-keeping display and said chronograph-hand.

2. A timepiece as set forth in claim 1 wherein the stepping motor drives additionally a chronograph minutes counter (8) and a chronograph hours counter (9).

3. A timepiece as set forth in claim 1 wherein the timekeeping display comprises a seconds hand (5), a minutes hand (4) and an hours hand (3).

4. A timepiece as set forth in claim 1 wherein the width of the motor drive pulses is slaved to the load to be driven by said motor.

5. In a timepiece having a time-keeping display and at least one chronograph display distinct from said time-keeping display, the improvement comprising:

a single stepping motor providing the only electromotive power for driving both said displays; and, a pulse source for applying pulses to said stepping motor at a fixed rate of between two and five pulses per second whereby said displays are advanced between two and five steps per second.

6. The improvement as claimed in claim 5 wherein said pulse source comprises an oscillator and a pulse divider responsive to said oscillator for applying said pulses to said stepping motor.

* * * * *